US009791817B2

(12) United States Patent
Takatoh

(10) Patent No.: US 9,791,817 B2
(45) Date of Patent: Oct. 17, 2017

(54) IMAGE FORMING APPARATUS USING VARIOUS KINDS OF CORRECTION PROCESSES

(71) Applicant: Sharp Kabushiki Kaisha, Sakai, Osaka (JP)

(72) Inventor: Kiyoshi Takatoh, Sakai (JP)

(73) Assignee: Sharp Kabushiki Kaisha, Sakai (JP)

( * ) Notice: Subject to any disclaimer, the term of this patent is extended or adjusted under 35 U.S.C. 154(b) by 0 days.

(21) Appl. No.: 15/373,886

(22) Filed: Dec. 9, 2016

(65) Prior Publication Data

US 2017/0176909 A1 Jun. 22, 2017

(30) Foreign Application Priority Data

Dec. 16, 2015 (JP) ..... 2015-244729
Nov. 9, 2016 (JP) ..... 2016-218528

(51) Int. Cl.
*G03G 15/00* (2006.01)
*G03G 15/16* (2006.01)

(52) U.S. Cl.
CPC ..... *G03G 15/5054* (2013.01); *G03G 15/16* (2013.01)

(58) Field of Classification Search
CPC ..... G03G 15/5054; G03G 15/16
USPC ..... 399/49, 51, 66
See application file for complete search history.

(56) References Cited

U.S. PATENT DOCUMENTS 6,288,733 B1 * 9/2001 Nakazawa ..... G03G 15/5041 399/49
8,467,101 B2 * 6/2013 Sugiyama ..... G03G 15/5054 347/131

FOREIGN PATENT DOCUMENTS

JP 2004-179768 A 6/2004

* cited by examiner

*Primary Examiner* — William J Royer
(74) *Attorney, Agent, or Firm* — Keating & Bennett, LLP

(57) ABSTRACT

An image forming apparatus includes a toner image forming portion, an information acquisition portion and a control portion. The control portion carries out processes (i) and (ii). In the process (i), the control portion causes the toner image forming portion to form, as a test image, at least either one of a toner image of single dot and a toner image of dot line consisting of single dots arranged in one or more rows in a predetermined direction, and then causes the information acquisition portion to acquire optical information on the formed test image. In the process (ii), the control portion corrects a condition for forming the toner image in the toner image forming portion, based on a state (size, concentration distribution, edge shape) of the test image obtained from the optical information acquired by the information acquisition portion.

4 Claims, 9 Drawing Sheets

IMAGE FORMING APPARATUS USING VARIOUS KINDS OF CORRECTION PROCESSES

CROSS REFERENCE

This Nonprovisional application claims priority under 35 U.S.C. §119(a) on Patent Application No. 2015-244729 filed in Japan on Dec. 16, 2015, and Patent Application No. 2016-218528 filed in Japan on Nov. 9, 2016, the entire contents of which are hereby incorporated by reference.

BACKGROUND OF THE INVENTION

1. Field of the Invention

The present invention relates to an image forming apparatus, and particularly relates to an image quality adjustment technology that is applied to the image forming apparatus according to an electrophotography method.

2. Description of Related Art

In the image forming apparatus according to the electrophotography method, in order that desired image quality is obtained, control parameter values are set beforehand for each gradation of respective colors that constitute a predetermined color space (for example, the CMYK color space). On the other hand, even when the image forming apparatus is controlled by the same control parameter values, gradations change due to the influence of environmental (temperature and/or humidity, etc.) change, time-related deterioration of the apparatus and so forth, which can make it difficult for the apparatus to reproduce desired gradations.

For this reason, various technologies to correct gradations have been proposed hitherto (for example, see Japanese Patent unexamined publication No. 2004-179768 bulletin). For the correction of gradations, typically, a test pattern showing a concentration change of each color is used. Here, the concentration change is often expressed by halftone dots or dot lines. Then, so that the desired gradation is reproduced, the control parameter values are corrected based on the concentration change of each color shown in the test pattern.

However, there has been a problem that even a patch representing the same gradation of the same color in the test pattern cannot necessarily reproduce the same concentration all the time. A major cause of this includes the fact that reproducibility in state of size, concentration distribution, edge shape or the like has deteriorated in a single dot or dot line. For this reason, with the conventional technologies, it has been difficult to realize a high-precision gradation correction.

SUMMARY OF THE INVENTION

An image forming apparatus according to the present invention comprises a toner image forming portion, an information acquisition portion and a control portion. The toner image forming portion includes an exposure portion that forms an electrostatic latent image on an image bearing member, a developing portion that renders the electrostatic latent image visible to form a toner image, and a transfer roller that transfers the toner image onto a transfer belt. The information acquisition portion acquires optical information on the toner image within a time after the toner image is transferred onto the transfer belt until the toner image is fixed on a paper sheet. Then, the control portion carries out processes (i) and (ii). That is, in the process (i), the control portion causes the toner image forming portion to form, as a test image, at least either one of a toner image of single dot and a toner image of dot line consisting of single dots arranged in one or more rows in a predetermined direction, and then causes the information acquisition portion to acquire optical information on the formed test image. In the process (ii), the control portion corrects a condition for forming the toner image in the toner image forming portion, based on a state of the test image obtained from the optical information acquired by the information acquisition portion.

DETAILED DESCRIPTION OF THE EMBODIMENTS

[1] First Embodiment

[1-1] Configuration of the Image Forming Apparatus

Figure 1:
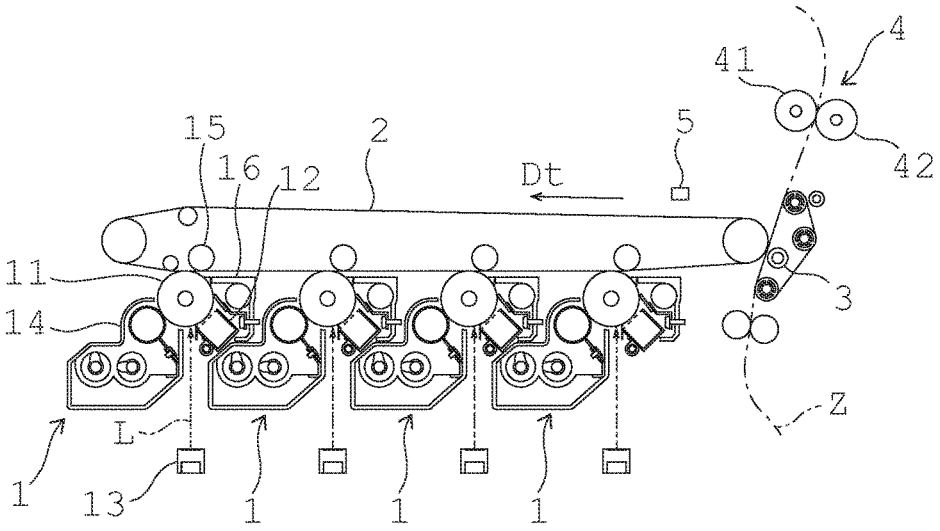
FIG. 1 is a schematic drawing showing major portions of an image forming apparatus according to an embodiment of the present invention.
Figure 2:
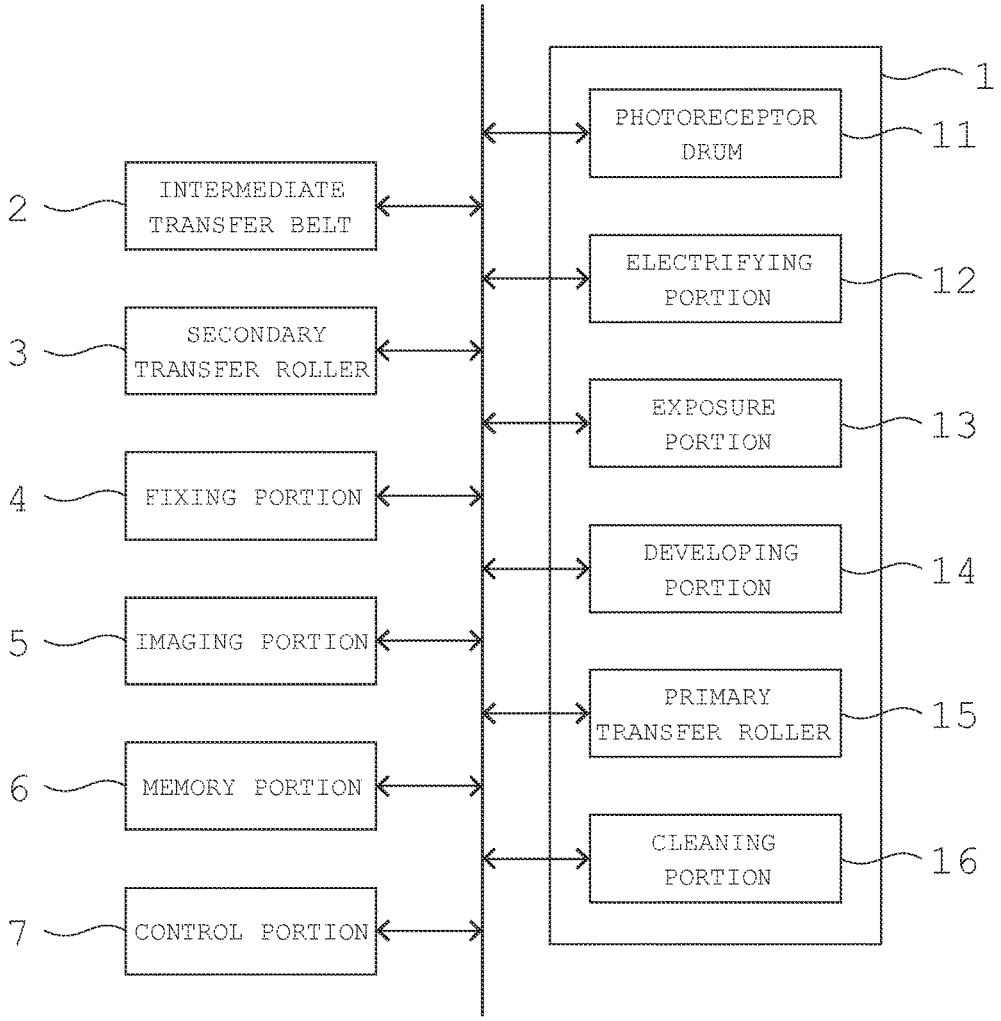
FIG. 2 is a block diagram of the image forming apparatus.

As shown in FIG. 1 and FIG. 2, an image forming apparatus performs an image forming process according to the electrophotography method based on image data, and thereby carries out an image printing onto a paper sheet Z. Specifically, the image forming apparatus comprises, as major portions thereof, four toner image forming portions 1, an intermediate transfer belt 2, a secondary transfer roller 3, a fixing portion 4, an imaging portion 5, a memory portion 6 and a control portion 7.

[Toner Image Forming Portion]

In the image forming apparatus according to this embodiment, the CMYK space is employed as a color space used. Then, the four toner image forming portions 1 are ones that respectively form toner images of four colors (cyan, magenta, yellow and black) that constitute the CMYK space. Also, the number of toner image forming portions 1 that are provided may be changed depending on the color space used. For example, in the case of the monochromatic image forming apparatus, the number of toner image forming portions 1 becomes one.

Each of the toner image forming portions 1 has a photoreceptor drum 11, an electrifying portion 12, an exposure portion 13, a developing portion 14, a primary transfer roller 15 and a cleaning portion 16.

The photoreceptor drum 11 is an electrostatic latent image bearing member. The electrifying portion 12 causes the photoreceptor drum 11 to be electrically charged so that a circumferential surface thereof becomes to have a predetermined electrical potential. The exposure portion 13 emits a laser L on the circumferential surface of the electrified photoreceptor drum 11, and thereby forms an electrostatic latent image depending on the image data.

The developing portion 14 renders the electrostatic latent image formed on the circumferential surface of the photoreceptor drum 11 visible to form a toner image. Specifically, the developing portion 14 applies a bias (developing bias) voltage to a developing roller, and thereby causes a toner sticking onto a circumferential surface of the developing roller to move, at a developing position, onto the circumferential surface of the photoreceptor drum 11. Thereby, the electrostatic latent image is rendered visible to form the toner image. The formed toner image is conveyed, through a rotation of the photoreceptor drum 11, to a position where transfer (primary transfer) of the toner image onto the intermediate transfer belt 2 is carried out.

The primary transfer roller 15 transfers the toner image borne by the photoreceptor drum 11 onto the intermediate transfer belt 2. Specifically, the primary transfer roller 15, with thereto applied bias (transfer bias) voltage, causes an electrostatic force to act on the toner forming the toner image, and utilizing the electrostatic force, causes the toner image to move onto the intermediate transfer belt 2.

The toner images of four colors respectively formed by the four toner image forming portions 1 based on the image data are transferred onto the same area of the intermediate transfer belt 2 in such a manner as not to be out of alignment with each other. Thus, the toner images of four colors overlap each other, thereby forming a full color toner image on the intermediate transfer belt 2. This full color toner image is conveyed, through a circulating motion of the intermediate transfer belt 2, to a position where transfer (secondary transfer) of the full color toner image onto the paper sheet Z is carried out.

The cleaning portion 16 removes the toner and other sticking substances (dust, etc.) remaining on the circumferential surface of the photoreceptor drum 11 after the primary transfer. This is to prepare for a next image forming process.

[Secondary Transfer Roller]

The secondary transfer roller 3 transfers the full color toner image borne by the intermediate transfer belt 2 onto the paper sheet Z. Specifically, the secondary transfer roller 3, with thereto applied bias voltage, causes an electrostatic force to act on the toner forming the toner image, and utilizing the electrostatic force, causes the toner image to move onto the paper sheet Z.

[Fixing Portion]

The fixing portion 4 has a heating roller 41 and a pressure roller 42 that is caused to be in contact with the heating roller 41 with pressure. The paper sheet Z onto which the toner image has been transferred is caused to pass between the heating roller 41 and the pressure roller 42, and thereby moderate heat and pressure is applied to the toner image. Thus, the toner image is fixed on the paper sheet Z.

[Imaging Portion]

The imaging portion 5 captures an image of the toner image, and thereby produces image data which is optical information on the toner image. In this embodiment, in order that recognition on state (size, concentration distribution, edge shape, etc.) of a single dot and/or dot line discussed later becomes possible in the image data obtained through imaging, a high resolution image sensor is used in the imaging portion 5. More specifically, taking a resolution of a single dot capable of being formed by the toner image forming portion 1 as a reference, an image sensor having a resolution not less than 4 times the reference is used in the imaging portion 5. For example, when the resolution of the single dot is 600 dpi, an image sensor having a resolution not less than 2400 dpi is preferable for the imaging portion 5. Moreover, the imaging portion 5 is not limited to the one that captures the image of the toner image transferred onto the intermediate transfer belt 2, but may be another that captures the image of the toner image at any time after the toner image is transferred onto the intermediate transfer belt 2 until fixed on the paper sheet Z.

[Memory Portion]

In the memory portion 6, image data used in printing, and set values for control parameters (laser L's duty, developing bias voltage, transfer bias voltage, etc.) that are used in controlling the respective portions (toner image forming portion 1, etc.) of the image forming apparatus are stored.

[Control Portion]

The control portion 7 controls respective portions of the image forming apparatus based on the image data and set values stored in the memory portion 6.

[1-2] Control of the Image Forming Apparatus

Subsequently, details of control performed by the control portion 7 in the image forming apparatus are explained. The control portion 7, in addition to performing a normal printing process, performs a gradation correction process so that desired image quality is obtained in printed matters. In this embodiment, the control portion 7 further carries out a size correction process so as to make it possible to perform a high-precision gradation correction process. In the following, details of the size correction process is explained referring to FIG. 3.

The control portion 7 first causes each of the toner image forming portions 1 to form a single dot toner image as a test image (Step S101). Then, the control portion 7 causes the imaging portion 5 to capture an image of the formed test image, thereby acquiring image data of the test image (Step S102). At this stage, the control portion 7 may either acquire the image data for each single dot of different colors respectively formed by the four toner image forming portions 1, or acquire one image data including all these single dots.

Regardless of the acquisition modes of the image data, the control portion 7 performs correction of a condition for forming the toner image for each of the toner image forming portions 1 based on the single dot formed by each of the toner image forming portions 1. Therefore, in the following, taking a certain toner image forming portion 1 and the single dot formed by the toner image forming portion 1 as the object, the process from the step S103 onward is explained. This also applies to processes explained from a second embodiment onward.

After the step S102, the control portion 7 calculates a size of the single dot from the acquired image data (Step S103). Specifically, the control portion 7 extracts pixels constituting the image of the single dot in the image data, and counts the number of the constituent pixels, thereby calculating a total number of the constituent pixels (number N1 of pixels) as the size of the single dot. At this stage, as the number N1 of pixels, the number of pixels corresponding to a width of the single dot in a predetermined direction (for example, a direction of a coordinate axis of the 2-dimensional coordinate system that is set in the image data) may be calculated.

After the step S103, the control portion 7 compares the number N1 of pixels (the size of the single dot) with a predetermined number Nt1 (Step S104). Here, the predetermined number Nt1 is a value of the number N1 of pixels that is set beforehand as the one corresponding to an appropriate size of the single dot. Specifically, the control portion 7 determines whether the number N1 of pixels has a value larger than the predetermined number Nt1, in agreement with the predetermined number Nt1, or smaller than the predetermined number Nt1. Here, the data of the predetermined number Nt1 is stored, for example, in the memory portion 6, and the control portion 7 reads out the data of the predetermined number Nt1 from the memory portion 6 when necessary.

As an example, the control portion 7 determines whether the difference (N1−Nt1) between the number N1 of pixels and the predetermined number Nt1 has a value larger than an upper limit of a predetermined range, within the predetermined range, or smaller than a lower limit of the predetermined range. Here, the predetermined range is a range within which the number N1 of pixels is recognizable as being in agreement with the predetermined number Nt1. And the result of determination that "the difference (N1−Nt1) has a value larger than the upper limit of the predetermined range" is equivalent to the result of determination that "the number N1 of pixels has a value larger than the predetermined number Nt1." The result of determination that "the difference (N1−Nt1) has a value within the predetermined range" is equivalent to the result of determination that "the number N1 of pixels has a value in agreement with the predetermined number Nt1." The result of determination that "the difference (N1−Nt1) has a value smaller than the lower limit of the predetermined range" is equivalent to the result of determination that "the number N1 of pixels has a value smaller than the predetermined number Nt1."

After that, the control portion 7 performs correction of a condition for exposure by the exposure portion 13 based on the result of comparison at step S104 when necessary (Steps S105 and S106). Specifically, when adjustment of the size of the single dot becomes necessary as a result of the comparison at step S104, the control portion 7 performs correction of power of the laser L (for example, peak output value and/or duty) output from the exposure portion 13. More specific explanations are as follows:

When the result of comparison at step S104 showing that "the number N1 of pixels has a value larger than the predetermined number Nt1 (N1>Nt1)" is obtained, the control portion 7 decreases the power of the laser L so that the size of the single dot becomes a proper size (Step S105). After that, the control portion 7 returns to step S101.

On the other hand, when the result of comparison at step S104 showing that "the number N1 of pixels has a value smaller than the predetermined number Nt1 (N1<Nt1)" is obtained, the control portion 7 increases the power of the laser L so that the size of the single dot becomes a proper size (Step S106). After that, the control portion 7 returns to step S101.

When the result of comparison at step S104 showing that "the number N1 of pixels has a value in agreement with the predetermined number Nt1 (N1=Nt1)" is obtained, the control portion 7 moves to step S107 without changing the power of the laser L.

Figure 3:
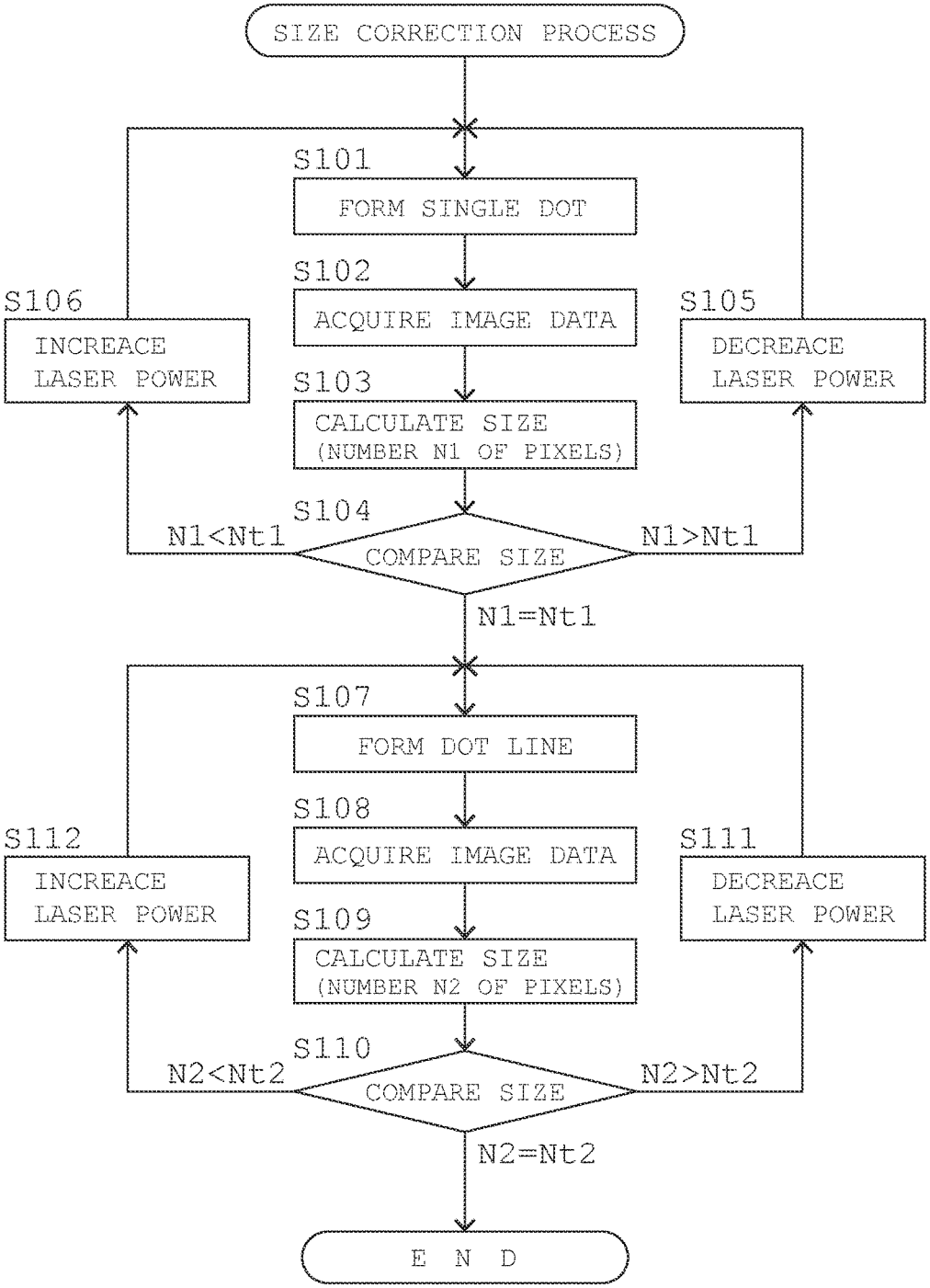
FIG. 3 is a flow chart showing a flow of a size correction process.

That is, in FIG. 3, steps S101-S106 are carried out repeatedly until the result of comparison at step S104 shows that "the number N1 of pixels has a value in agreement with the predetermined number Nt1 (N1=Nt1)." Additionally, in the size correction process on the single dot, not limited to the above-mentioned procedure, when the result of comparison at step S104 showing that "the number N1 of pixels has a value larger than the predetermined number Nt1 (N1>Nt1)", or that "the number N1 of pixels has a value smaller than the predetermined number Nt1 (N1<Nt1)" is obtained, the control portion 7, after having performed the correction process that causes the laser power to decrease or increase, may move to step S107 without returning to step S101.

In the step S107, the control portion 7 causes each of the toner image forming portions 1 to form, as a test image, a toner image of one or more dot lines consisting of single dots arranged in one or more rows, respectively, in a predetermined direction (hereinafter, simply referred to as "dot line"). Here, the predetermined direction is, for example, the main scanning direction or the sub scanning direction. Then, the control portion 7 causes the imaging portion 5 to capture an image of the formed test image, thereby acquiring image data of the test image (Step S108). At this stage, the control portion 7 may either acquire the image data for each dot line of different colors respectively formed by the four toner image forming portions 1, or acquire one image data including all these dot lines.

Regardless of the acquisition modes of the image data, the control portion 7 performs correction of a condition for forming the toner image for each of the toner image forming portions 1 based on the dot line formed by each of the toner image forming portions 1. Therefore, in the following, taking a certain toner image forming portion 1 and the dot line formed by the toner image forming portion 1 as the object, the process from the step S108 onward is explained. This also applies to processes explained from the second embodiment onward.

After the step S107, the control portion 7 calculates a width of the dot line from the acquired image data (Step S109). Specifically, the control portion 7 extracts pixels constituting the image of the dot line in the image data, and counts the number of the constituent pixels in the width direction of the dot line. Thereby, the control portion 7 calculates a total number of the constituent pixels (number N2 of pixels) in the width direction as the size of the dot line.

After the step S109, the control portion 7 compares the number N2 of pixels (the width of the dot line) with a predetermined number Nt2 (Step S110). Here, the predetermined number Nt2 is a value of the number N2 of pixels that is set beforehand as the one corresponding to an appropriate width of the dot line. Specifically, the control portion 7 determines whether the number N2 of pixels has a value larger than the predetermined number Nt2, in agreement with the predetermined number Nt2, or smaller than the predetermined number Nt2. Here, the data of the predetermined number Nt2 is stored, for example, in the memory portion 6, and the control portion 7 reads out the data of the predetermined number Nt2 from the memory portion 6 when necessary.

As an example, the control portion 7 determines whether the difference (N2−Nt2) between the number N2 of pixels and the predetermined number Nt2 has a value larger than an upper limit of a predetermined range, within the predetermined range, or smaller than a lower limit of the predetermined range. Here, the predetermined range is a range within which the number N2 of pixels is recognizable as being in agreement with the predetermined number Nt2. And the result of determination that "the difference (N2−Nt2) has a value larger than the upper limit of the predetermined range" is equivalent to the result of determination that "the number N2 of pixels has a value larger than the predetermined number Nt2." The result of determination that "the difference (N2−Nt2) has a value within the predetermined range" is equivalent to the result of determination that "the number N2 of pixels has a value in agreement with the predetermined number Nt2." The result of determination that "the difference (N2−Nt2) has a value smaller than the lower limit of the predetermined range" is equivalent to the result of determination that "the number N2 of pixels has a value smaller than the predetermined number Nt2."

After that, the control portion 7 performs correction of the condition for exposure by the exposure portion 13 based on the result of comparison at step S110 when necessary (Steps S111 and S112). Specifically, when adjustment of the width of the dot line becomes necessary as a result of the comparison at step S110, the control portion 7 performs correction of the power of the laser L (for example, peak output value and/or duty) output from the exposure portion 13. More specific explanations are as follows:

When the result of comparison at step S110 showing that "the number N2 of pixels has a value larger than the predetermined number Nt2 (N2>Nt2)" is obtained, the control portion 7 decreases the power of the laser L so that the width of the dot line becomes a proper width (Step S111). After that, the control portion 7 returns to step S107.

On the other hand, when the result of comparison at step S110 showing that "the number N2 of pixels has a value smaller than the predetermined number Nt2 (N2<Nt2)" is obtained, the control portion 7 increases the power of the laser L so that the width of the dot line becomes a proper width (Step S112). After that, the control portion 7 returns to step S107.

When the result of comparison at step S110 showing that "the number N2 of pixels has a value in agreement with the predetermined number Nt2 (N2=Nt2)" is obtained, the control portion 7 ends the size correction process without changing the power of the laser L, and moves to the gradation correction process.

That is, in FIG. 3, steps S107-S112 are carried out repeatedly until the result of comparison at step S110 showing that "the number N2 of pixels has a value in agreement with the predetermined number Nt2 (N2=Nt2)" is obtained. Additionally, in the size correction process on the dot line, not limited to the above-mentioned procedure, when the result of comparison at step S110 showing that "the number N2 of pixels has a value larger than the predetermined number Nt2 (N2>Nt2)", or that "the number N2 of pixels has a value smaller than the predetermined number Nt2 (N2<Nt2)" is obtained, the control portion 7, after having performed the correction process that causes the laser power to decrease or increase, may end the size correction process without returning to step S107.

In the gradation correction process, the control portion 7 causes the toner image forming portions 1 to form, respectively, a test pattern showing concentration change of each color. Then, the control portion 7 performs correction of a gradation of each color based on the concentration change the test pattern shows.

With the above-mentioned size correction process, because the sizes of the single dot and the dot line are corrected, reproducibility of those sizes improves. Therefore, at the time of forming the test pattern used in the gradation correction, reproducibility of the concentration change of each color improves. Thus, the image forming apparatus according to the first embodiment makes it possible to perform a high-precision gradation correction.

Also, not limited to the case where both of the process insteps S101-S106 and the process in steps S107-S112 are carried out as in this embodiment, only either one of the processes may be carried out as the size correction process.

In addition, the single dot test image may either be one that is formed of a plurality of single dots separated with each other with a space equivalent to one or more dots, or another that is formed of a plurality of single dots arranged in a halftone dot form with spaces between the dots thereof. Moreover, the dot line test image may be one that is formed of a plurality of dot lines separated with each other with a space equivalent to one or more rows thereof. In this manner, using a plurality of single dots or dot lines as the test image makes it easy to recognize the single dot and/or the dot line. This also applies to various kinds of correction processes explained in later embodiments.

Further, using a plurality of single dots or dot lines as the test image makes it possible to use, in the size comparison at step S104 or S110, a mean value of sizes obtained from the plurality of single dots or dot lines as the size to be compared with the predetermined number Nt1 or Nt2. This makes it possible to perform a size correction process that takes account of variations in size.

[2] Second Embodiment

Figure 4:
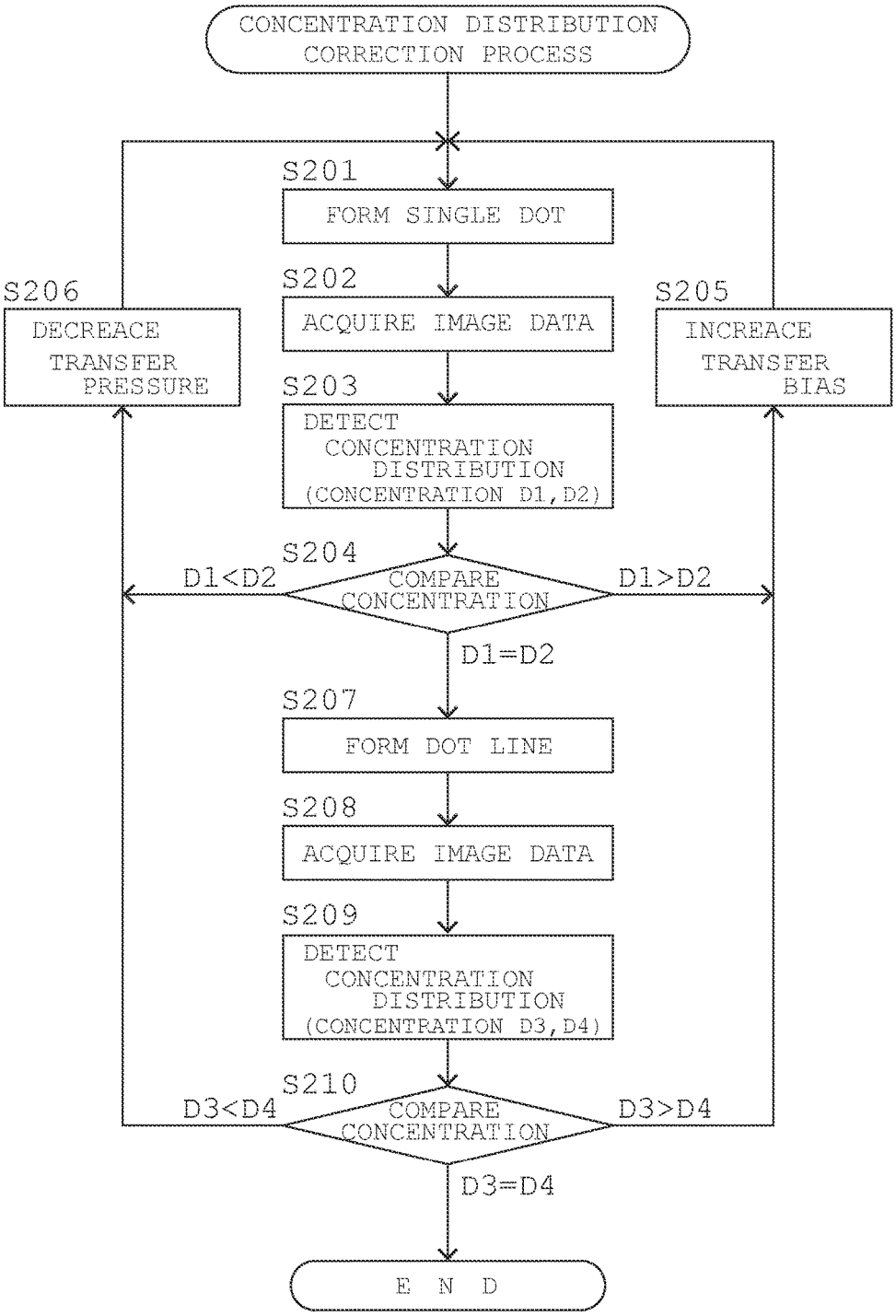
FIG. 4 is a flow chart showing a flow of a concentration distribution correction process.

The control portion 7 may, so as to make it possible to perform a high-precision gradation correction process, carry out a concentration distribution correction process instead of the size correction process. In the following, details of the concentration distribution correction process is explained referring to FIG. 4. Also, as explained in a sixth embodiment, the concentration distribution correction process may be used in combination with the above-mentioned size correction process.

At steps S201 and S202, the same processes as at steps S101 and S102 in the first embodiment are carried out, respectively. After the step S202, the control portion 7 detects a concentration distribution of the single dot from the acquired image data (Step S203). Specifically, the control portion 7 extracts pixels constituting the image of the single dot in the image data, and calculates, based on pixel values of the extracted pixels, concentration D1 of the central part of the single dot and concentration D2 of the edge part thereof.

After the step S203, the control portion 7 performs a comparison between the two concentrations D1 and D2 (Step S204). Specifically, the control portion 7 determines whether the concentration D1 has a value larger than the concentration D2, in agreement with the concentration D2, or smaller than the concentration D2.

As an example, the control portion 7 determines whether the difference (D1−D2) between the two concentrations D1 and D2 has a value larger than an upper limit of a predetermined range, within the predetermined range, or smaller than a lower limit of the predetermined range. Here, the predetermined range is a range within which the concentration D1 is recognizable as being in agreement with the concentration D2. And the result of determination that "the difference (D1−D2) has a value larger than the upper limit of the predetermined range" is equivalent to the result of determination that "the concentration D1 has a value larger than the concentration D2." The result of determination that "the difference (D1−D2) has a value within the predetermined range" is equivalent to the result of determination that "the concentration D1 has a value in agreement with the concentration D2." The result of determination that "the difference (D1−D2) has a value smaller than the lower limit of the predetermined range" is equivalent to the result of determination that "the concentration D1 has a value smaller than the concentration D2."

After that, the control portion 7 performs correction of a condition for transfer by the primary transfer roller 15 based on the result of comparison at step S204 when necessary (Steps S205 and S206). Specifically, when adjustment of the concentration distribution of the single dot becomes necessary as a result of the comparison at step S204, the control portion 7 performs correction of the transfer bias voltage and/or transfer pressure of the primary transfer roller 15. More specific explanations are as follows:

When the result of comparison at step S204 showing that "the concentration D1 has a value larger than the concentration D2 (D1>D2)" is obtained, the control portion 7 increases the transfer bias voltage so that the concentration of the single dot becomes uniform (Step S205). After that, the control portion 7 returns to step S201.

On the other hand, when the result of comparison at step S204 showing that "the concentration D1 has a value smaller than the concentration D2 (D1<D2)" is obtained, the control portion 7 decreases the transfer pressure so that the concentration of the single dot becomes uniform (Step S206). After that, the control portion 7 returns to step S201.

When the result of comparison at step S204 showing that "the concentration D1 has a value in agreement with the concentration D2 (D1=D2)" is obtained, the control portion 7 moves to step S207 without changing the transfer bias voltage nor transfer pressure.

At steps S207 and S208, the same processes as at steps S107 and S108 in the first embodiment are carried out, respectively. After the step S208, the control portion 7 detects a concentration distribution of the dot line from the acquired image data (Step S209). Specifically, the control portion 7 extracts pixels constituting the image of the dot line in the image data, and calculates, based on pixel values of the extracted pixels, concentration D3 of the central part of the dot line and concentration D4 of the end part(s) thereof in the width direction of the dot line.

After the step S209, the control portion 7 performs a comparison between the two concentrations D3 and D4 (Step S210). Specifically, the control portion 7 determines whether the concentration D3 has a value larger than the concentration D4, in agreement with the concentration D4, or smaller than the concentration D4.

As an example, the control portion 7 determines whether the difference (D3−D4) between the two concentrations D3 and D4 has a value larger than an upper limit of a predetermined range, within the predetermined range, or smaller than a lower limit of the predetermined range. Here, the predetermined range is a range within which the concentration D3 is recognizable as being in agreement with the concentration D4. And the result of determination that "the difference (D3−D4) has a value larger than the upper limit of the predetermined range" is equivalent to the result of determination that "the concentration D3 has a value larger than the concentration D4." The result of determination that "the difference (D3−D4) has a value within the predetermined range" is equivalent to the result of determination that "the concentration D3 has a value in agreement with the concentration D4." The result of determination that "the difference (D3−D4) has a value smaller than the lower limit of the predetermined range" is equivalent to the result of determination that "the concentration D3 has a value smaller than the concentration D4."

After that, the control portion 7 performs correction of the condition for transfer by the primary transfer roller 15 based on the result of comparison at step S210 when necessary (Steps S205 and S206). Specifically, when adjustment of the concentration distribution of the dot line becomes necessary as a result of the comparison at step S210, the control portion 7 performs correction of the transfer bias voltage and/or transfer pressure of the primary transfer roller 15. More specific explanations are as follows:

When the result of comparison at step S210 showing that "the concentration D3 has a value larger than the concentration D4 (D3>D4)" is obtained, the control portion 7 increases the transfer bias voltage so that the concentration of the dot line becomes uniform (Step S205). After that, the control portion 7 returns to step S201.

On the other hand, when the result of comparison at step S210 showing that "the concentration D3 has a value smaller than the concentration D4 (D3<D4)" is obtained, the control portion 7 decreases the transfer pressure so that the concentration of the dot line becomes uniform (Step S206). After that, the control portion 7 returns to step S201.

When the result of comparison at step S210 showing that "the concentration D3 has a value in agreement with the concentration D4 (D3=D4)" is obtained, the control portion 7 ends the concentration distribution correction process without changing the transfer bias voltage nor transfer pressure, and moves to the gradation correction process.

With the above-mentioned concentration distribution correction process, because the concentration distributions of the single dot and the dot line are corrected, reproducibility of those concentration distributions improves. Therefore, at the time of forming the test pattern used in the gradation correction, reproducibility of the concentration change of each color improves. Thus, the image forming apparatus according to the second embodiment makes it possible to perform a high-precision gradation correction.

Also, not limited to the case where both of the process insteps S201-S206 and the process in steps S207-S210, S205 and S206 are carried out as in this embodiment, only either one of the processes may be carried out as the concentration distribution correction process.

Here, when the process in steps S207-S210, S205 and S206 is carried out alone, the control portion 7, after carrying out each of steps S205 and S206, results in returning to step S207.

Also, using a plurality of single dots or dot lines as the test image makes it possible to use, in the concentration comparison at step S204 or S210, a mean value of concentrations obtained from the plurality of single dots or dot lines as the concentration to be compared. This makes it possible to perform a concentration distribution correction process that takes account of variations in concentration.

[3] Third Embodiment

Figure 5:
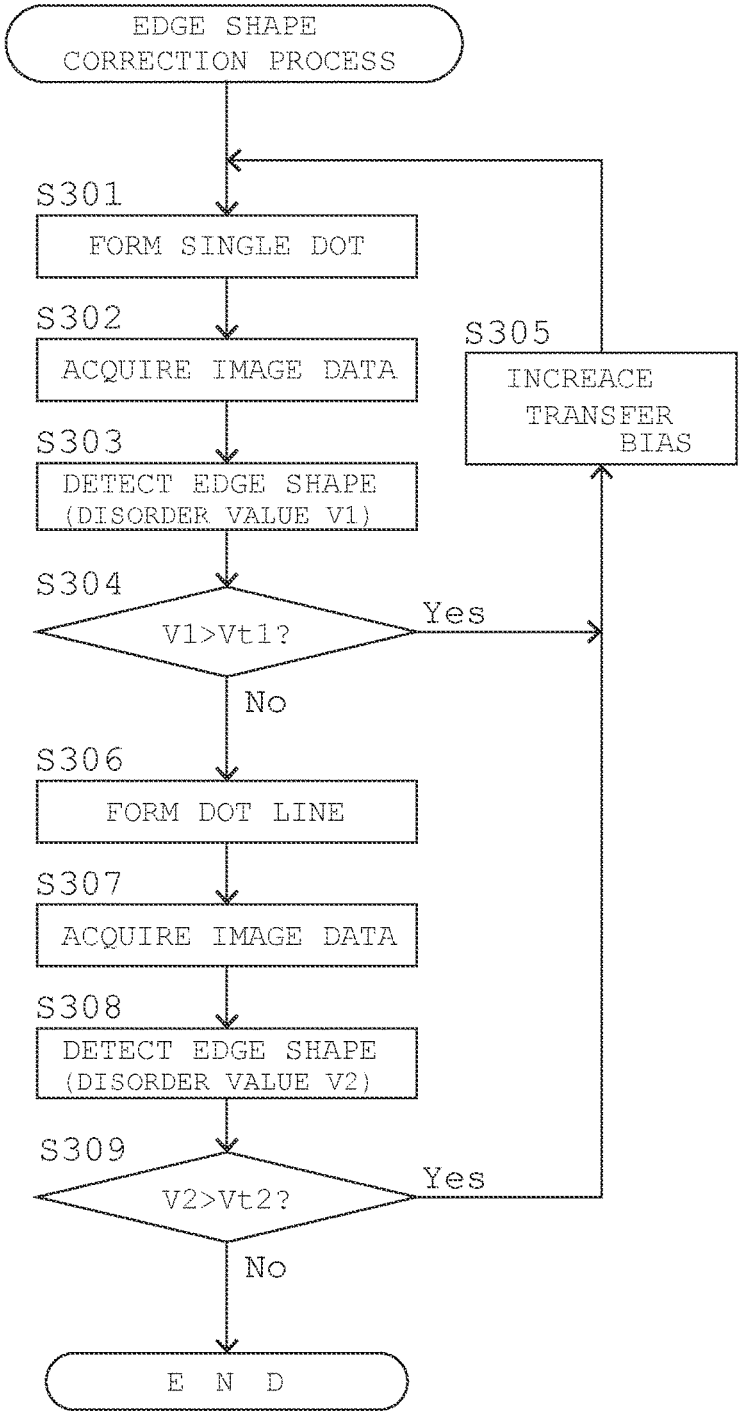
FIG. 5 is a flow chart showing a flow of an edge shape correction process.

The control portion 7 may, so as to make it possible to perform a high-precision gradation correction process, carry out an edge shape correction process instead of the size correction process and/or the concentration distribution correction process. In the following, details of the edge shape correction process is explained referring to FIG. 5. Also, as explained in a sixth embodiment, the edge shape correction process may be used in combination with the above-mentioned size correction process and/or concentration distribution correction process.

At steps S301 and S302, the same processes as at steps S101 and S102 in the first embodiment are carried out, respectively. After the step S302, the control portion 7 detects an edge shape of the single dot from the acquired image data (Step S303). Specifically, the control portion 7 extracts pixels (edge pixels) constituting the edge of the single dot in the image data, and calculates, based on the extracted edge pixels, a disorder value V1 representing a degree of disorder of the extracted edge shape.

As an example, the control portion 7 calculates a center coordinate of the edge pixels from coordinates thereof in a 2-dimensional coordinate system that is set in the image data, and calculates each distance from the center coordinate to the coordinate of each edge pixel. Then, the control portion 7 obtains, as the disorder value V1, a standard deviation representing variations in the calculated distance.

After the step S303, the control portion 7 determines whether the disorder value V1 is larger than a predetermined value Vt1 or not (Step S304). Here, the predetermined value Vt1 is an upper limit value of the disorder value V1 if not greater than which the edge shape is recognizable as being a proper shape (circular shape). Here, the data of the predetermined value Vt1 is stored, for example, in the memory portion 6, and the control portion 7 reads out the data of the predetermined value Vt1 from the memory portion 6 when necessary.

After that, the control portion 7 performs correction of a condition for transfer by the primary transfer roller 15 based on the result of determination at step S304 when necessary (Step S305). Specifically, when adjustment of the edge shape of the single dot becomes necessary as a result of the determination at step S304, the control portion 7 performs correction of the transfer bias voltage of the primary transfer roller 15. More specific explanations are as follows:

When the result of determination at step S304 showing that "the disorder value V1 has a value larger than the predetermined value Vt1 (Yes)" is obtained, the control portion 7 increases the transfer bias voltage so that the edge shape of the single dot approaches a circular shape (Step S305). After that, the control portion 7 returns to step S301.

On the other hand, when the result of determination at step S304 showing that "the disorder value V1 has a value not larger than the predetermined value Vt1 (No)" is obtained, the control portion 7 moves to step S306 without changing the transfer bias voltage.

At steps S306 and S307, the same processes as at steps S107 and S108 in the first embodiment are carried out, respectively. After the step S307, the control portion 7 detects an edge shape of the dot line from the acquired image data (Step S308). Specifically, the control portion 7 extracts pixels (edge pixels) constituting the edge of the dot line in the image data, and calculates, based on the extracted edge pixels, a disorder value V2 representing a degree of disorder of the extracted edge shape.

As an example, the control portion 7 calculates each width of the dot line at each position in the extending direction of the dot line from coordinates of the edge pixels in a 2-dimensional coordinate system that is set in the image data. Then, the control portion 7 obtains, as the disorder value V2, a standard deviation representing variations in the calculated width.

After the step S308, the control portion 7 determines whether the disorder value V2 is larger than a predetermined value Vt2 or not (Step S309). Here, the predetermined value Vt2 is an upper limit value of the disorder value V2 if not greater than which the edge shape is recognizable as being a proper shape (rectilinear shape). Also, the data of the predetermined value Vt2 is stored, for example, in the memory portion 6, and the control portion 7 reads out the data of the predetermined value Vt2 from the memory portion 6 when necessary.

After that, the control portion 7 performs correction of the condition for transfer by the primary transfer roller 15 based on the result of determination at step S309 when necessary (Step S305). Specifically, when adjustment of the edge shape of the dot line becomes necessary as a result of the determination at step S309, the control portion 7 performs correction of the transfer bias voltage of the primary transfer roller 15. More specific explanations are as follows:

When the result of determination at step S309 showing that "the disorder value V2 has a value larger than the predetermined value Vt2 (Yes)" is obtained, the control portion 7 increases the transfer bias voltage so that the edge shape of the dot line approaches a rectilinear shape (Step S305). After that, the control portion 7 returns to step S301.

On the other hand, when the result of determination at step S309 showing that "the disorder value V2 has a value not larger than the predetermined value Vt2 (No)" is obtained, the control portion 7 ends the edge shape correction process without changing the transfer bias voltage, and moves to the gradation correction process.

With the above-mentioned edge shape correction process, because the edge shapes of the single dot and the dot line are corrected, reproducibility of those edge shapes improves. Therefore, at the time of forming the test pattern used in the gradation correction, reproducibility of the concentration change of each color improves. Thus, the image forming apparatus according to the third embodiment makes it possible to perform a high-precision gradation correction.

Also, not limited to the case where both of the process insteps S301-S305 and the process in steps S306-S309 and S305 are carried out as in this embodiment, only either one of the processes may be carried out as the edge shape correction process. Here, when the process in steps S306-S309 and S305 is carried out alone, the control portion 7, after carrying out the step S305, results in returning to step S306.

Further, using a plurality of single dots or dot lines as the test image makes it possible to use, in the disorder value comparison at step S304 or S309, a mean value of the disorder values obtained from the plurality of single dots or dot lines as the disorder value to be compared with the predetermined number Vt1 or Vt2. This makes it possible to perform an edge shape correction process that takes account of variations in edge shape.

[4] Fourth Embodiment

Figure 6:
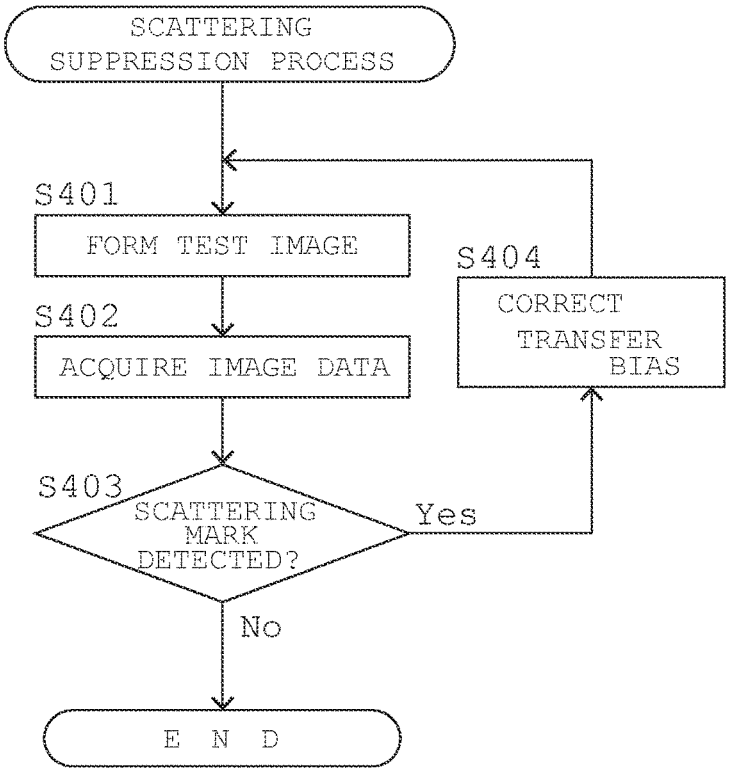
FIG. 6 is a flow chart showing a flow of a scattering suppression process.

In the above-mentioned first to third embodiments, the control portion 7 may carry out a scattering suppression process so as to suppress scattering of the toner that can occur when the toner image is transferred onto the intermediate transfer belt 2. In the following, details of the scattering suppression process is explained referring to FIG. 6.

The control portion 7 first causes each of the toner image forming portions 1 to form a toner image of the single dot or dot line as the test image (Step S401). Then, the control portion 7 causes the imaging portion 5 to capture an image of the formed test image, thereby acquiring image data of the test image (Step S402).

Also, in the case where the scattering suppression process is incorporated in between the steps S102 and S103, and/or in between the steps S108 and S109 in the first embodiment, the image data obtained at steps S102 and/or S109 can be substituted for image data to be acquired at step S402. Accordingly, the steps S401 and S402 may be omitted. This also applies to cases where the scattering suppression process is incorporated in the various kinds of correction processes in the second and third embodiments.

After the step S402, the control portion 7 detects, from the acquired image data, presence or absence of a toner scattering mark that can occur when the test image is transferred onto the intermediate transfer belt 2 (Step S403). Specifically, the control portion 7 extracts pixels constituting the image of the test image (single dot or dot line) in the image data, and determines whether there is any pixel having the same level of pixel value as the extracted pixels around thereof or not.

Then, when the result of determination showing that there is a pixel having the same level of pixel value as the extracted pixels is obtained, the control portion 7, recognizing that the toner scattering mark has been detected, moves to step S404. On the other hand, when the result of determination showing that there is no pixel having the same level of pixel value as the extracted pixels is obtained, the control portion 7, recognizing that the toner scattering mark has not been detected, ends the scattering suppression process.

At the step S404, the control portion 7 performs correction of a condition for transfer by the primary transfer roller 15 so that the toner scattering at the time of transfer will not occur. Specifically, the control portion 7 causes the transfer bias voltage to increase or decrease. After that, the control portion 7 returns to step S401.

With the above-mentioned scattering suppression process, the toner scattering that can occur when the toner image (including the test image) is transferred onto the intermediate transfer belt 2 is suppressed. Therefore, in each of the size correction process (first embodiment), the concentration distribution correction process (second embodiment), and the edge shape correction process (third embodiment), influence of the scattering mark is eliminated, thereby high-precision correction processes are realized.

[5] Fifth Embodiment

Figure 7:
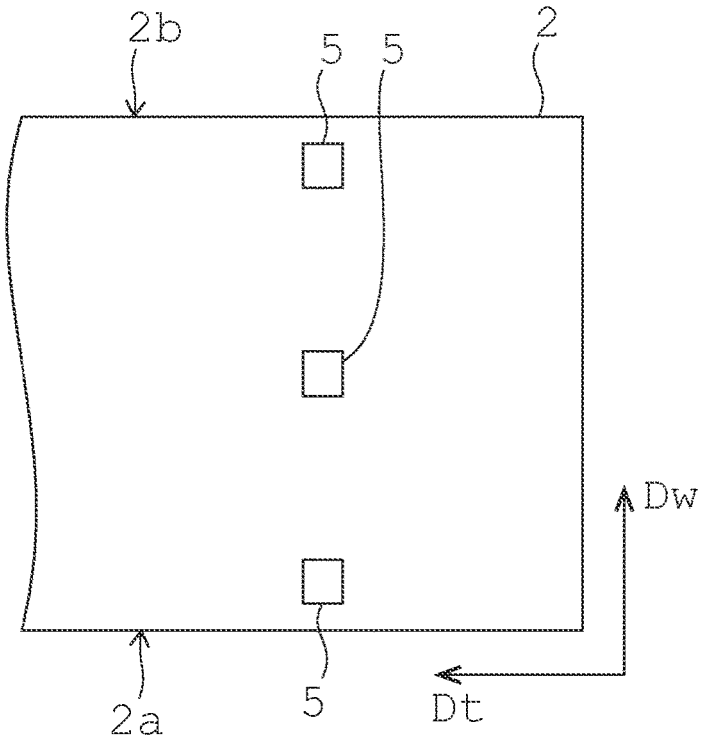
FIG. 7 is a top view showing an arrangement of imaging portions in another embodiment.

In the above-mentioned first to fourth embodiments, the control portion 7 may cause each of the toner image forming portions 1 to form a test image at each of a plurality of different positions with respect to the width direction Dw (direction orthogonal to the direction of conveyance Dt; see FIG. 7) of the intermediate transfer belt 2. In this case, the imaging portion 5 is provided corresponding to each of the plurality of positions at which the test images are formed. For example, in the width direction Dw of the intermediate transfer belt 2, in the case where a test image is to be formed at each of a position near the front edge 2*a*, a position near the center, and a position near the rear edge 2*b*, the imaging portion 5 is provided, as shown in FIG. 7, corresponding to each of these positions.

Then, the control portion 7 performs correction of a condition for forming the toner image corresponding to each of the positions, by performing the various kinds of correction processes using the image data of the test image at each of the positions. Therefore, with the image forming apparatus according to the fifth embodiment, variations in size, concentration distribution, edge shape and so forth of the single dot and dot line that can occur depending on the positional difference with respect to the width direction Dw of the intermediate transfer belt 2 are corrected.

Also, for the plurality of positions where test images are formed, test images different from each other may be formed. For example, forming the single dot for each of the position near the front edge 2*a* and the position near the rear edge 2*b* whereas forming the dot line for the position near the center may be acceptable. This makes it possible to cause the various kinds of correction processes for the single dot and the various kinds of correction processes for the dot line to be carried out in parallel, and thus to complete the various kinds of correction processes in a short time.

[6] Sixth Embodiment

Figure 8:
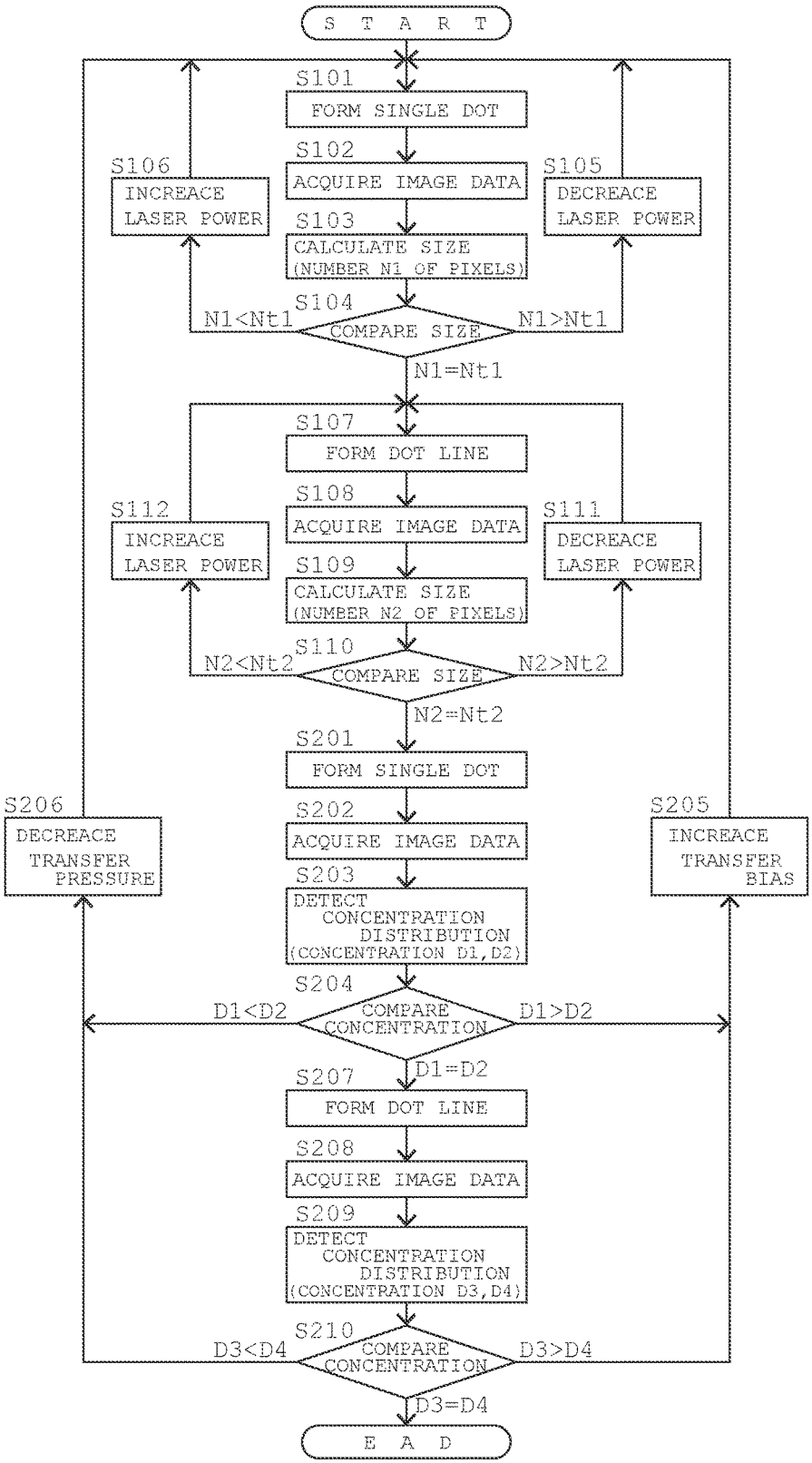
FIG. 8 is a flow chart showing a flow in which the size correction process and the concentration distribution correction process are combined.
Figure 9:
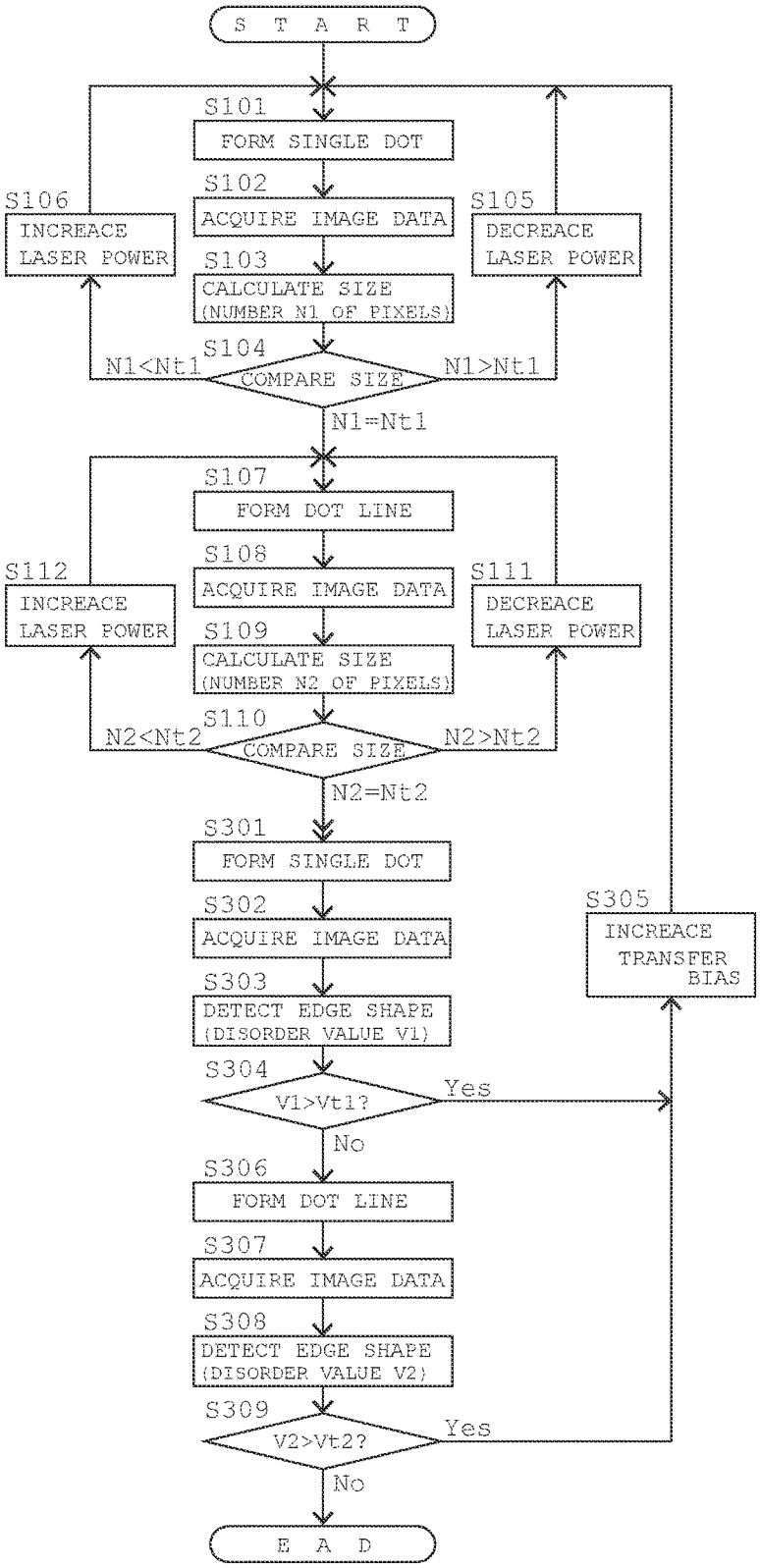
FIG. 9 is a flow chart showing a flow in which the size correction process and the edge shape correction process are combined.

The above-mentioned various kinds of correction processes may be used alone respectively, or otherwise, some or all thereof may be used in combination. As an example, FIG. 8 is a flow chart showing a flow when the size correction process and the concentration distribution correction process are combined. As another example, FIG. 9 is a flowchart showing a flow when the size correction process and the edge shape correction process are combined. In either case, it is preferable that the process step returns to step S101 after the condition for transfer by the primary transfer roller 15 is corrected (after any one of the steps S205, S206 and S305 is carried out).

[7] Other Examples

The various kinds of correction processes in the above-mentioned first to sixth embodiments may be carried out with any timing in the control of the image forming apparatus. Such execution timing includes, for example, at a time when the printing of a predetermined number of paper sheets is completed, while the apparatus is in stand-by state, just before a printing is carried out, at start-up (turning on) of the image forming apparatus, etc. Also, the various kinds of correction processes may be carried out automatically under the surveillance by the control portion 7, or may be carried out when either one of those selectably displayed on the screen of the operation panel or the like is selected. Further, when it is determined by the control portion 7 that in order to prevent an abrupt concentration change or the like execution of any of the various kinds of correction processes is necessary, the process execution of which is determined to be necessary may be selectably displayed on the screen of the operation panel or the like. In this case, it is possible to let the user to determine whether it is necessary to carry out the process or not.

Also, in the various kinds of correction processes in the above-mentioned first to sixth embodiments, the control portion 7, instead of performing corrections of the condition for exposure by the exposure portion 13 and/or the condition for transfer by the primary transfer roller 15, or in addition to these corrections, may perform corrections of various conditions for forming the toner image in the toner image forming portion 1 such as a condition for electrification by the electrifying portion 12, a condition for development by the developing portion 14 and so forth.

Due to the fact that a black-colored transfer belt is often used for the intermediate transfer belt 2, for the black toner, the black test image of the single dot and/or dot line, etc. may be formed on a solid image that is prepared using a toner having a color other than black (yellow or the like). This makes it possible to easily recognize the state (size, concentration distribution, edge shape, etc.) of the test image from the image data.

Further, the state (size, concentration distribution, edge shape, etc.) of the test image of the single dot and/or dot line, etc. is not limited to the one obtained directly from the image data obtained by the imaging portion 5, but may be others obtained indirectly from the reflectivity and/or the like of the test image measured by the optical sensor. In this case, using the conventional configuration, it is possible to recognize indirectly a state of the test image from the reflectivity and/or the like, and then to reflect the state to the condition for exposure and/or the condition for transfer. For example, from the reflectivity, using a concentration correction table and/or the like, it is possible to perform correction of the condition for exposure and/or the condition for transfer.

Configurations of the respective portions in the above-mentioned image forming apparatus can be applied to varieties of image forming apparatus such as color multi-functional apparatus, color copier, color printer, etc. Also, the above-mentioned configurations of the respective portions can be applied not only to image forming apparatus for color image, but also to image forming apparatus for monochromatic image.

The above explanations of the embodiments are nothing more than illustrative in any respect, nor should be thought of as restrictive. Scope of the present invention is indicated by claims rather than the above embodiments. Further, it is intended that all changes that are equivalent to a claim in the sense and realm of the doctrine of equivalence be included within the scope of the present invention.

What is claimed is:

1. An image forming apparatus comprising:

a toner image forming portion including an exposure portion that forms an electrostatic latent image on an image bearing member, a developing portion that renders the electrostatic latent image visible to form a toner image, and a transfer roller that transfers the toner image onto a transfer belt;

an information acquisition portion that acquires optical information on the toner image within a time after the toner image is transferred onto the transfer belt until the toner image is fixed on a paper sheet; and a control portion, wherein the control portion carries out:

(i) a process that causes the toner image forming portion to form, as a test image, at least either one of a toner image of single dot and a toner image of dot line consisting of single dots arranged in one or more rows in a predetermined direction, and then causes the information acquisition portion to acquire optical information on the formed test image; and (ii) a process that corrects a condition for forming the toner image in the toner image forming portion, based on a state of the test image obtained from the optical information acquired by the information acquisition portion.

2. The image forming apparatus according to claim 1, wherein the state of the test image includes at least any one of size, concentration distribution and edge shape.

3. The image forming apparatus according to claim 1, wherein the control portion further carries out:

(iii) a process that detects, from the optical information acquired by the information acquisition portion, presence or absence of a toner scattering mark that can occur when the test image is transferred onto the transfer belt; and (iv) a process that corrects, when necessary, a condition for transfer by the transfer roller based on the result of detection in the process (iii).

4. The image forming apparatus according to claim 1, wherein in the process (i), the control portion causes the toner image forming portion to form the test image at each of a plurality of different positions with respect to a width direction of the transfer belt;

the information acquisition portion is provided corresponding to each of the plurality of positions; and in the process (ii), the control portion, using optical information on the test image at each of the positions, corrects a condition for forming the toner image corresponding to each of the positions.

* * * * *